US005130705A

United States Patent [19]

Allen et al.

[11] Patent Number: 5,130,705

[45] Date of Patent: Jul. 14, 1992

[54] DOWNHOLE WELL DATA RECORDER AND METHOD

[75] Inventors: James R. Allen; Fred V. Pomeroy, both of Anchorage, Ak.

[73] Assignee: Petroleum Reservoir Data, Inc., Anchorage, Ak.

[21] Appl. No.: 633,457

[22] Filed: Dec. 24, 1990

[51] Int. Cl.[5] ..... E21B 47/00

[52] U.S. Cl. ..... 340/853.9; 166/66; 166/250; 175/40

[58] Field of Search ..... 166/250, 66; 175/40; 340/853.9

[56] References Cited

U.S. PATENT DOCUMENTS

| | | | |
|---|---|---|---|
| 3,466,597 | 9/1969 | Richter, Jr. et al. | 340/853 |
| 3,559,165 | 1/1971 | Schwartz | 340/474 |
| 4,216,536 | 8/1980 | More | 367/83 |
| 4,660,638 | 4/1987 | Yates, Jr. | 166/250 |
| 4,806,153 | 2/1989 | Sakai | 73/151 |

OTHER PUBLICATIONS

"New Technology Improved Monitoring Ability", Appearing in the Oil and Gas Journal issue of May 8, 1989, at pp. 43 and 44 Teledyne Merla General Catalog 1980–81.

*Primary Examiner*—J. W. Eldred

*Attorney, Agent, or Firm*—Graybeal Jackson Haley & Johnson

[57] ABSTRACT

Self-contained, preprogrammable downhole well data recorder and method of use thereof, the recorder having the external configuration of a conventional sidepocket gas lift valve and being placeable and retrievable from a conventional gas lift sidepocket mandrel by a conventional valve positioning tool. The recorder monitors and collects fluid dynamics data downhole during well operations, such as stimulation, production and multi-zone well completions, without impeding fluid flow. Programming can involve selective actuation of one or more of the sensors intermittently for at least thirty days. After retrieval of the recorder, fluid dynamics data stored in memory is outputted to external equipment for analysis in a manner known per se.

5 Claims, 3 Drawing Sheets

DOWNHOLE WELL DATA RECORDER AND METHOD

BACKGROUND OF THE INVENTION

1. Field of the Invention

The present invention relates to downhole well recorders and methods of use thereof, and more particularly to methods of monitoring and collecting fluid dynamics data downhole in a well pipe, and to preprogrammed electronic recorders therefor which are installable in and retrievable from sidepocket mandrels.

2. Description of the Prior Art

The monitoring of fluid dynamics in oil wells and the like, during various operations such as production, fracturing and testing of wall integrity, require collection of data which are as accurate as possible, at various selected locations in a well. Some of the known techniques for monitoring well operations and developing the necessary data are discussed in an article entitled "New Technology Improved Monitoring Ability", appearing in the Oil and Gas Journal issue of May 8, 1989, at pages 43 and 44. Sensing surface pressure data is one known technique but does not give sufficiently accurate data since it inherently is unable to account for viscosity, density and friction losses as they occur downhole and data sensed at the surface must be extrapolated to even approximate downhole conditions. Placing pressure and temperature sensors downhole in a so-called dead string or wireline manner is also known but the suspension means can interfere with the operation of the well and can also prove cumbersome. Wireline placement of sensors also cannot satisfactorily develop data as to fluid dynamics externally of the well pipe.

Another disadvantage of wireline placement of sensors downhole is that such tend to restrict flow in the well pipe and are also subject to being adversely affected by some well stimulation materials which can be highly abrasive and highly corrosive.

Also known, such as disclosed in More U.S. Pat. No. 4,216,536, for example, are monitoring systems which place sensors downhole and transmit data recorded downhole up to the drilling platform using pressure pulses in the mud circulated through the drill string, a technique known as Mud Pulse Telemetry (MPT). In such a system, data is sensed and stored in a downhole microprocessor when the mud is not circulating and the data is subsequently transmitted to the surface while the mud is circulating. Alternatively, the data sensed downhole can be transmitted to the surface in real time using MPT, which data is then later compared for accuracy with the data as recorded downhole.

SUMMARY OF THE INVENTION

By configuring a self-contained, programmable electronic recorder to have the same configuration as a retrievable gas lift valve, and placing such in a gas lift side pocket mandrel, the recorder can be placed downhole and retrieved in the same manner as a standard sidepocket gas lift valve and can use the same seal surfaces and latches as are used for gas lift valves. By such placement the recorder can measure fluid dynamics on site either inside or outside of a well pipe.

The use of recorders according to the present invention during oil well stimulation enables the monitoring and collection of fluid dynamics data as the well stimulation operation occurs and makes it possible to develop more accurate data, which in turn makes it possible to program future stimulation procedures to be more effectively applied. A major advantage of sensing and recording the fluid dynamics in a sidepocket location is that there is no friction loss and no need for surface extrapolation of data to downhole conditions, particularly in deviated wells. By placement of the recorder in a gas lift side pocket mandrel, the recorder is out of the flow path of abrasive and corrosive well stimulation materials when such are present. In addition, data can be collected wherever there is a standard gas lift mandrel in the well pipe and can monitor conditions either inside or outside the pipe.

Another important feature and advantage of recorders according to the present invention is that, in the isolated zones encountered in multi-zone well completions, zone communication and casing cement integrity can be tested for and water flood calculations can be made for individual zones. In this respect, zone isolation data was simply not available before this invention because downhole wire line supported recorders cannot be used to collect fluid dynamics data in an isolated zone.

In oil well stimulation by fracturing, it is vital to evaluate the permeability and the proppant dispersant in situ as the fracture is being done. Having data generated at or near the formation face eliminates the guesswork involved when one must extrapolate surface data to downhole conditions. With the use of the monitoring method provided by the present invention, petroleum engineers have been able to design stimulation programs with more finite results, particularly in deviated wells where the friction coefficients are far less predictable than in vertical holes. In production fields where stimulation programs are done on a large scale, the data from using this method has enabled a significant increase in well permeability and sharply lowered the cost per well. By using additional devices for multi-zone wells, data can be collected from adjoining zones during stimulation to find communication, if any, between zones and to determine what possible influence the stimulation program might have on adjoining zones. After a stimulation program is completed, by placing multiple devices in individual zones of a multi-zone well, data can be obtained as to the character of inter-zone communication and from this data the engineers can develop a more comprehensive description of the reservoir dynamics among individual zones.

These and other features, advantages and characteristics of downhole well data recorders and methods of use thereof according to the present invention will be readily understood by those skilled in the art to which the invention is addressed, in the light of the following description of a typical embodiment thereof.

DESCRIPTION OF THE PREFERRED EMBODIMENT

Figure 1:
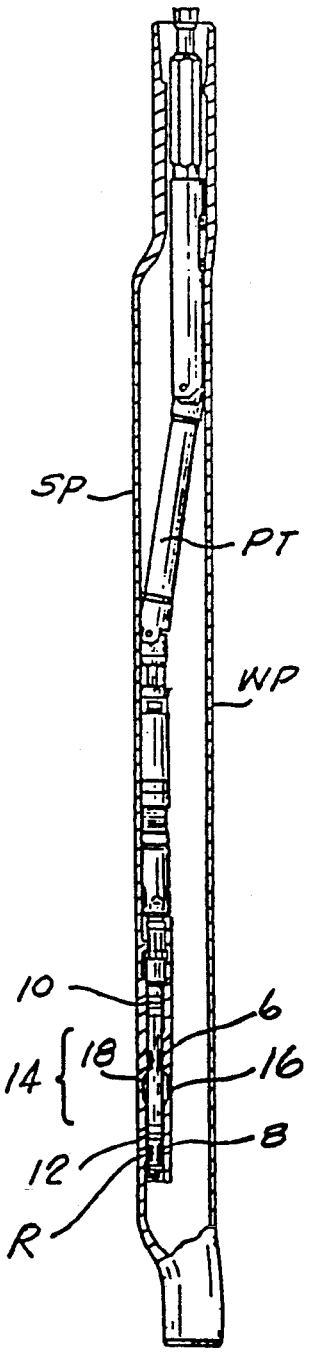
FIG. 1 is a side elevational view, partly in cross section, of a typical well pipe section including a conventional sidepocket mandrel in which an electronic recorder according to the present invention is being placed by a conventional placement tool and technique.

FIG. 1 illustrates a typical conventional well pipe section WP with a sidepocket portion SP, also called a sidepocket mandrel such as disclosed in U.S. Pat. No. 3,994,339, into the lower bore 10, 12 of which a programmable electronic recorder R is being placed by a conventional positioning tool PT. As will be recognized, well pipe sections WP with gas lift sidepocket mandrels SP are widely used in oil wells and the like, it being common practice in the laying of oil pipe down the well hole to intersperse a series of such well pipe sections with dummy gas lift valves in place even though operative gas lift valves might not be used in the pipe string until some time later, and that emplacing and retrieving such valves or similar structure, such as the recorder R of the present invention, is by use of well known positioning tools PT, such as disclosed in Goode U.S. Pat. No. 3,876,001 entitled "Kickover Tool" and owned by Teledyne Merla of Garland, Texas, and Anchorage, Alaska. Known as well in the industry is the fact that sidepocket mandrels and gas lift valves, such as marketed by Teledyne Merla, are available and used with seal rings 6,8 at the bores 10, 12 to form what is called a pocket 14 therebetween around the gas lift valve, with the mandrel being provided with porting leading to either the internal wall of the pocket or external wall of the pocket. Such porting is not shown on FIG. 1 hereof but will be understood as providing communication either to the inside of the well pipe (through wall 16) or to the outside of the well pipe (through wall 18) from pocket 14. Thus, by way of example, a typical Teledyne Merla sidepocket mandrel bears a model designation TPDC and the similar sidepocket mandrel with external porting bears the model designation TPDE. As will be evident, when the recorder R of the present invention is substituted for a conventional gas lift valve, like bore seals are used therearound in the bores 10, 12 to provide a like pocket 14 and have available to it either internal or external porting from the pocket 14, depending on the type of sidepocket mandrel in which the recorder R is installed.

Figure 2:
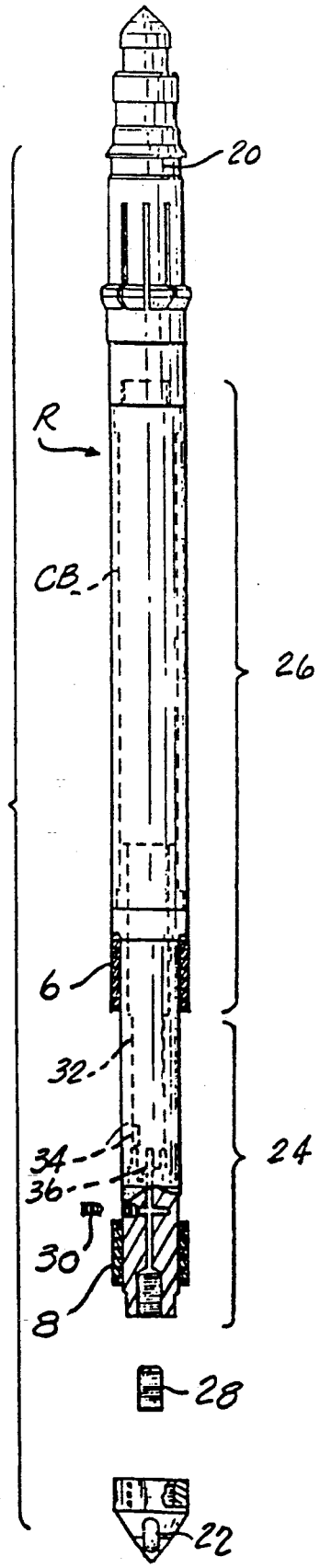
FIG. 2 is an enlarged, exploded view in side elevation and partly in cross section, of the recorder shown in FIG. 1.

As shown in more detail in FIG. 2, the recorder R has a tail portion 20 configured like that of a gas lift valve and adapted to be engaged by the positioning tool PT, a head cap 22 which is internally threaded to engage the threads of a sensor and port assembly 24. The main body of the recorder R, internally thereof, houses in chamber 26 the circuit board CB carrying electronic components, such components being hereinafter discussed more fully in connection with FIG. 3 and 4. Respective porting plugs 28, 30 are provided for alternative placement or removal when the fluid communication to the sensors is to be internal or external of the pocket 14.

The sensor porting assembly 24 also includes in pressure chamber 32 the fluid condition sensors, namely, in the example presented, the temperature sensor 34 and the pressure sensor 36. As will be understood, other sensors can be employed as well in certain embodiments, such as a pH probe, a densitometer, and a viscometer.

Figure 3:
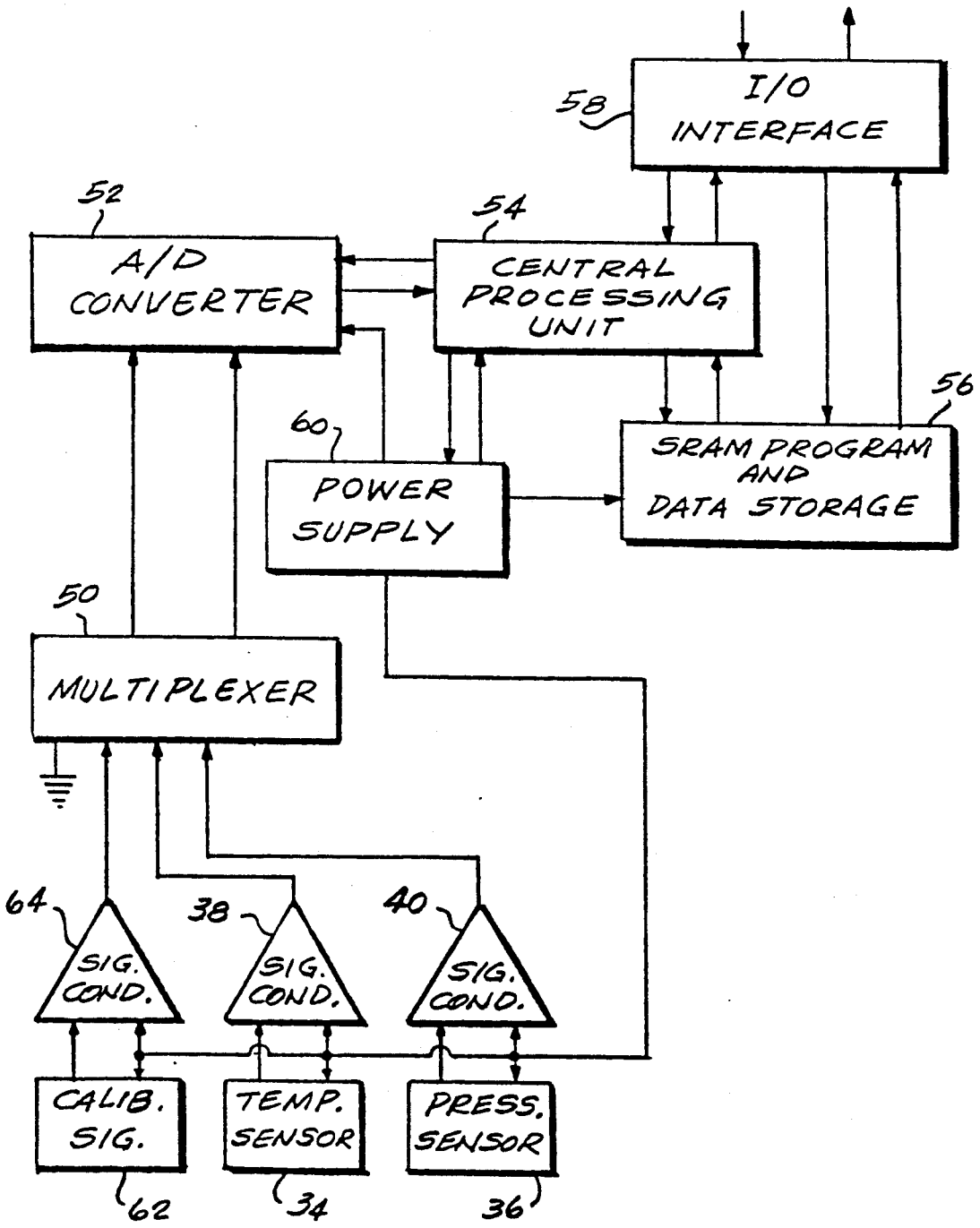
FIG. 3 is a functional block diagram of the recorder components housed in the recorder shown in FIG. 2.

FIG. 3 is a block diagram showing of the various sensors 34, 36, and the recorder electrical components housed in chamber 26 of the recorder R. As shown in FIG. 3, outputs from the respective sensors pass through respective signal conditioners 38, 40 which function to filter noise and scale voltage signals, and, if necessary, to convert a current signal to a voltage signal appropriate for the multiplexer 50 and for digitization in the A/D converter 52, from which they are delivered through the central processing unit 54 to memory storage in the SRAM (static random access memory) program and data storage unit 56. Also contained in unit 56 are the programming instructions for the central processing unit 54 which in turn controls the multiplexer 50, the A/D converter 52, the data storage in unit 56, and the input/output signals received from or delivered to the I/O interface port 58.

The entire data collection system is supplied with d.c. voltage from battery powered power supply 60. Power is delivered to the other components from power supply 60 only intermittently on a preprogrammed basis under control of the central processing unit 54, e.g. at intervals of one second every fifteen minutes, for example. This enables use of battery power and long term operation (e.g. thirty days or more).

A separate calibration signal is provided by signal source 62 and applied through signal conditioner 64 and and multiplexer 50 to the A/D converter 52 and is used to confirm proper system function.

Figure 4:
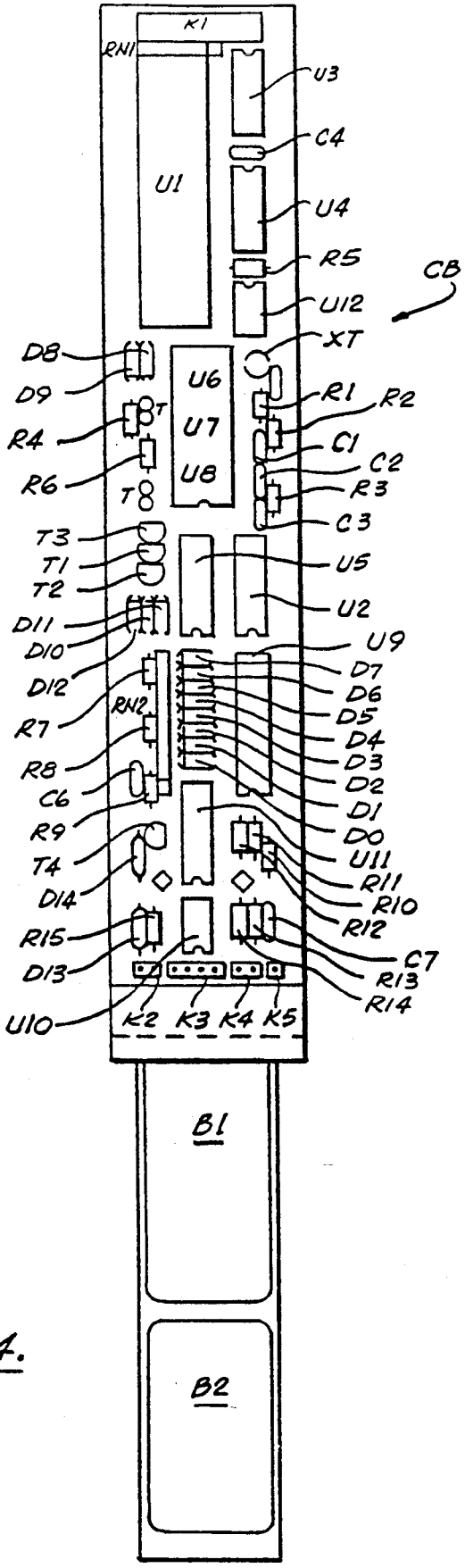
FIG. 4 is a diagrammatic view of the layout of certain electrical components on the printed circuit board of a typical recorder as shown in FIG. 2.

FIG. 4 illustrates the layout of the electrical components of a typical circuit board CB as used in a recorder R configured according to the present invention.

The nature and functions of the components on circuit board CB are as follows:

| Component code | Nature and function |
|---|---|
| B1,B2 | Batteries |
| C1–C7 | Capacitors |
| D0–D14 | Transistors |
| K1 | 18 pin female connector for proprietary parallel interface bus between Date Probe and external analytical equipment. Used for communication (programming and data retrieval) between Data Probe and external analytical equipment. |
| K2 | Power supply connector |
| K3 | Pressure sensor signal connector |
| K4 | Temperature sensor signal connector |
| K5 | Power supply connector |
| R1–R15 | Resistors |
| RM1,RM2 | Resistor networks |
| T,T1,T2,T3,T4 | Power switches for controlling power to memory ICs, A/D converter and sensors. |
| U1 | Central Processing Unit (CPU) |
| U2 | Memory Address Latch integrated circuit (IC) |
| U3 | Logic gate IC for conditioning control signals from CPU |
| U4 | Logic gate IC for conditioning control signals from CPU |
| U5 | Memory chip select logic IC |
| U6,U7,U8 | Random access memory ICs (SRAM) |
| U9 | Analog to Digital conversion IC |
| U10 | Sensor signal conditioning IC |
| U11 | Sensor signal switches for sensor signal multiplexing |
| U12 | Clock signal generating IC for CPU |
| XT | Oscillator crystal |

Either or both of the sensors can be activated at preprogrammed internals with the output signals being digitized and routed to central processing unit 54, which in turn writes the data into the memory portion of unit 56.

To begin a monitoring exercise, with new batteries (B1,B2, see FIG. 4) installed in power supply 60 and the CPU 54 programmed through the I/O interface 58 with the desired inputs as to the selection of sensors, time set, and the monitoring interval. The assembled recorder R is then placed in a selected side pocket mandrel SP to monitor either external or internal fluid dynamics depending on how the selected mandrel and the recorder are ported. The well operation at hand is then commenced and continued for whatever duration is desired. The recorder R is then retrieved from the sidepocket, and the stored data is downloaded through the I/O interface 58 to external analytical equipment. After this operation the recorder again can be placed in service in another well following battery replacement and reprogramming for a monitoring run, with either the same or a different combination, data collection intervals and durations.

As will be apparent, other or additional sensors can be similarly employed in a recorder of the type disclosed and other sensor output processing microcircuitry and layouts can be employed in practice of the invention, consistent with the basic proposition of a preprogrammable, self-contained, dynamic fluid condition recorder with data memory, positionable into and retrievable from a downhole location not materially impeding fluid flow, i.e. in a sidepocket mandrel, within the scope of the following claims.

What is claimed is:

1. A pre-programmable electronic recorder for sensing and recording in memory fluid dynamics data downhole in an oil well, said recorder having the same external configuration as a gas lift valve and being installable in and retrievable from a sidepocket mandrel in the well pipe of the oil well in the same manner as a lift valve of like external configuration is installable and retrievable, said recorder comprising fluid dynamics sensor means, a static random access memory (SRAM) program, means for conditioning, multiplexing, digitizing and storing the data generated by the sensor means, a central processing unit controlling the data collection, and battery type power supply means controlled by the central processing unit and energizing the data generation and storage components on a intermittent, preprogrammed basis over a period of at least about thirty days, the periods of non-energization of the data generation and storage components being at least several hundred times longer than the periods of energization thereof.

2. The downhole recorder of claim 1, further comprising an input/output interface by which the central processing unit is preprogrammmed prior to placement of the recorder downhole in the sidepocket mandrel, such preprogramming establishing the frequency and interval of activation of the data collection, the said input-output interface also enabling the transfer of the collected data to external analytical equipment after retrieval of the recorder from the well.

3. The downhole recorder of claim 2, wherein the central processing unit energizes the data generation and storage components for an interval of about one second about every fifteen minutes.

4. The downhole recorder of claim 2, wherein the sensor means comprises temperature sensor means and pressure sensor means.

5. A pre-programmable electronic recorder for sensing and recording in memory pressure and temperature data downhole in an oil well, said recorder having the same external configuration as a lift valve and being installable in and retrievable from a sidepocket mandrel in the well pie of the oil well in the same manner as a lift valve of like external configuration is installable and retrievable, said recorder comprising pressure sensing means and temperature sensing means, a status random access memory (SRAM) program, means for conditioning, multiplexing, digitizing and storing the data generated by the sensor means, central processing unit controlling the data collection, and battery type power supply means controlled by the central processing unit and energizing selected data generation and storage components on an intermittent, preprogrammed basis over a long period, said recorder comprising a main body provided at one end thereof with a sensor pocket with an interior chamber, the said pressure sensor means and said temperature sensor means being exposed to in said interior chamber, axially directed porting means and radially directed porting means in said pocket in fluid communication with said interior chamber, and threaded porting plugs alternately installable and removable from each of said axially directed porting means and radially directed porting means by which said interior chamber and consequently said pressure sensor means and said temperature sensing means are established in communication with oil either interiorly of or exteriorly of the sidepocket mandrel.

* * * * *